US011248890B2

(12) United States Patent
Dudee

(10) Patent No.: US 11,248,890 B2
(45) Date of Patent: Feb. 15, 2022

(54) ENHANCED BALLISTICS AND PROJECTILES

(71) Applicant: Jitander Dudee, Lexington, KY (US)

(72) Inventor: Jitander Dudee, Lexington, KY (US)

( * ) Notice: Subject to any disclaimer, the term of this patent is extended or adjusted under 35 U.S.C. 154(b) by 0 days.

(21) Appl. No.: 16/935,256

(22) Filed: Jul. 22, 2020

(65) Prior Publication Data

US 2021/0025681 A1 Jan. 28, 2021

Related U.S. Application Data

(60) Provisional application No. 62/876,959, filed on Jul. 22, 2019.

(51) Int. Cl.
*F42B 12/24* (2006.01)
*F42B 12/46* (2006.01)
*F41A 21/06* (2006.01)

(52) U.S. Cl.
CPC ..... *F42B 12/24* (2013.01); *F42B 12/46* (2013.01); *F41A 21/06* (2013.01)

(58) Field of Classification Search
CPC ..... F42B 10/34; F42B 12/24; F42B 12/34; F42B 12/367; F42B 12/40; F42B 12/46; F41A 21/02; F41A 21/06; F41A 21/16; F41A 21/20; F41A 21/28
USPC ..... 102/491, 494, 506, 507, 513, 517, 520, 102/521, 522, 524; 89/14.05; 42/76.01
See application file for complete search history.

(56) References Cited

U.S. PATENT DOCUMENTS

| | | | | |
|---|---|---|---|---|
| 734,966 | A * | 7/1903 | Schou | F42B 12/38 102/513 |
| 2,592,434 | A * | 4/1952 | Krasnow | F42B 12/36 102/513 |
| 6,874,403 | B2 * | 4/2005 | Strayn | F41A 21/48 89/160 |
| 2010/0258020 | A1 * | 10/2010 | Rastegar | F41J 2/00 102/209 |
| 2013/0112100 | A1 * | 5/2013 | Bunczk | F42B 10/40 102/374 |
| 2016/0238358 | A1 * | 8/2016 | Sorokin | F42B 10/025 |
| 2017/0322001 | A1 * | 11/2017 | Panousakis | F42B 5/10 |

* cited by examiner

*Primary Examiner* — Bret Hayes
(74) *Attorney, Agent, or Firm* — Black, McCuskey, Souers & Arbaugh, LPA

(57) ABSTRACT

A projectile launching system can include a projectile launcher and a projectile. The projectile launcher can include at least one barrel, a projectile, a firing pin mechanism, an activator, and a power system. The barrel can extend along a longitudinal axis between first and second ends, with an exit port at the second end. The projectile can be positioned in the barrel and include primer, propellant, and a sub-projectile. The firing pin mechanism can be selectively project into the barrel to engage the primer, whereby the propellant is ignited and the projectile is launched out of the barrel. The activator can be engaged with the firing pin mechanism and engageable by a user to control the firing pin mechanism. The power system can rotate the barrel or the projectile as the firing pin mechanism is projecting into the barrel and engaging the primer of the projectile.

10 Claims, 4 Drawing Sheets

ENHANCED BALLISTICS AND PROJECTILES

CROSS-REFERENCE TO RELATED APPLICATIONS

This application claims the benefit of U.S. Provisional Patent Application Ser. No. 62/876,959 for ENHANCED BALLISTICS AND PROJECTILES, filed on 2019 Jul. 22, which is hereby incorporated by reference in its entirety.

BACKGROUND

1. Field

The present disclosure relates to projectiles, such as bullets and shells, and enhancing the firing of such projectiles for maximizing flight performance.

2. Description of Related Prior Art

U.S. Pat. No. 9,528,805 discloses PROVIDING SPIN TO COMPOSITE PROJECTILE. A projectile according to the '805 patent includes a body preferably in the shape of a bullet and having a density less than the density of lead. The projectile further includes a stabilizer adhered to the body. The stabilizer is configured to engage rifling of a barrel of a firearm and impart rotation to the projectile as the projectile travels through the barrel. A preferred ammunition cartridge includes a primer, a propellant, and the aforesaid projectile, as well as a casing containing the primer, propellant and projectile, with the projectile projecting from the casing. Other projectiles in accordance with aspects and features of the invention further are disclosed.

The background description provided herein is for the purpose of generally presenting the context of the disclosure. Work of the presently named inventor, to the extent it is described in this background section, as well as aspects of the description that may not otherwise qualify as prior art at the time of filing, are neither expressly nor impliedly admitted as prior art against the present disclosure.

SUMMARY

A projectile launching system can include a projectile launcher and a projectile. The projectile launcher can include at least one barrel, a projectile, a firing pin mechanism, an activator, and a power system. The at least one barrel can extend along a longitudinal axis between a first end and a second end. The second end defines an exit port of the barrel. The projectile can be positioned in the at least one barrel closer to the first end. The projectile can include a primer, a quantity of propellant, and at least one sub-projectile. The firing pin mechanism can be positioned at the first end and can be configured to, at least partially, selectively project into the at least one barrel and engage the primer of the projectile whereby the quantity of propellant is ignited and the projectile is launched through and out of the at least one barrel. The activator can be engaged with the firing pin mechanism and engageable by a user of the projectile launcher to control the firing pin mechanism to project into the at least one barrel and engage the primer of the projectile. The power system can be engaged with at least one of the at least one barrel and the projectile and can be configured to rotate the at least one of the at least one barrel and the projectile about the longitudinal axis as the firing pin mechanism is projecting into the at least one barrel and engaging the primer of the projectile.

BRIEF DESCRIPTION OF THE DRAWINGS

The detailed description set forth below references the following drawings.

DETAILED DESCRIPTION

Figure 1:
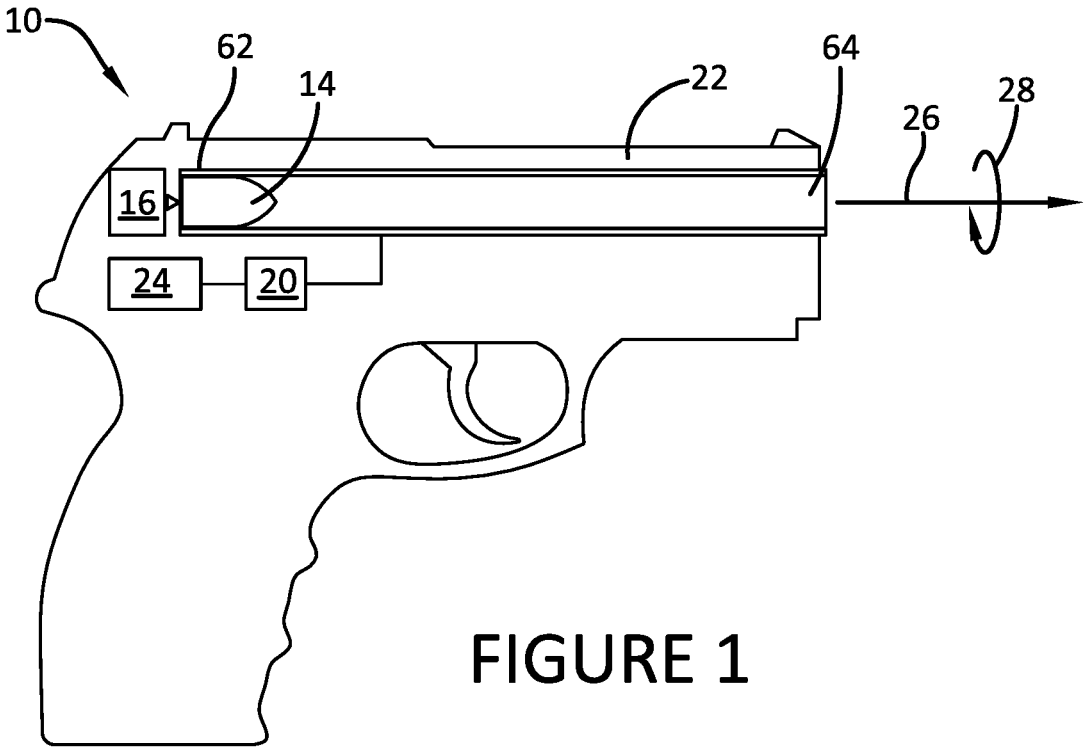
FIG. 1 is a schematic side view of a revolver incorporating an exemplary embodiment of the present disclosure.

Similar features are shown in the various structures disclosed in the present disclosure. Similar features across different structures have been numbered with a common reference numeral and have been differentiated by an alphabetic suffix. Similar features in a particular structure have been numbered with a common two-digit, base reference numeral and have been differentiated by a different leading numeral. Also, to enhance consistency, the structures in any particular drawing may share the same alphabetic suffix even if a particular feature is shown in less than all structures. Similar features are structured similarly, operate similarly, and/or have the same function unless otherwise indicated by the drawings or this specification. Furthermore, particular features of one structure can replace corresponding features in another structure or can supplement other structures unless otherwise indicated by the drawings or this specification.

The present disclosure provides a projectile launching system that includes a projectile launcher and a projectile. Embodiments of the present disclosure can be practiced in revolvers and rifles, for example, for firing bullets. Other embodiments of the present disclosure can be practiced in artillery pieces for firing shells. In at least one exemplary embodiment, a projectile such as a bullet can be made to spin about the axis of its trajectory prior to be being fired from a barrel of a projectile launcher. It is noted that the bullet can be initially positioned in a chamber defined by the barrel. The spinning of the bullet can allow for better gyroscopic stability during travel while concurrently enhancing the transfer of kinetic energy from the bullet to the target over the amount of energy that could be delivered by velocity alone. Imparting spinning before the bullet passes though the barrel can also enhance the amount of energy possessed by the projectile upon leaving the barrel, as energy is lost in existing systems because of friction between the barrel and the bullet to create spinning through rifling.

In one or more embodiments of the present disclosure, the pre-firing spinning can be accomplished by spinning the barrel in which the bullet is positioned. A spinning barrel can hold, aim and impart rotational energy to the bullet. A revolver 10 incorporating an exemplary embodiment of the present disclosure is disclosed in FIG. 1. It is noted that, while a revolver is chosen as an exemplary embodiment of the present disclosure, any structure configured to launch/fire a projectile is contemplated as an operating environment for one or more embodiments of the present disclosure. The revolver 10 is an exemplary projectile launcher and includes a barrel 12. The exemplary barrel 12 extends along a longitudinal axis 26 between a first end 62 and a second end 64. The second end 66 defines an exit port of the barrel 12. A bullet 14 is an exemplary projectile and is positioned in the barrel 12. The exemplary projectile 14 is positioned in the exemplary barrel 12 closer to the first end 62.

The exemplary revolver 10 also includes firing pin mechanism, shown schematically and referenced at 16. The exemplary firing pin mechanism 16 is positioned at the first end 62 and configured to, at least partially, selectively project into the exemplary barrel 12 and engage the primer of the projectile 14. When the firing pin mechanism 16 projects into the exemplary barrel 12 and engage the primer of the projectile 14, a quantity of propellant of the projectile 14 is ignited and the projectile 14 is launched through and out of the exemplary barrel 12.

The exemplary revolver 10 also includes a trigger 18 that can be engaged by a human user to activate the firing pin mechanism 16. The trigger 18 is an exemplary activator engaged with the firing pin mechanism 16 and engageable by a user of the projectile launcher 10 to control the firing pin mechanism 16 to project into the barrel 12 and engage the primer of a projectile positioned in the barrel 12. In other embodiments of projectile launcher contemplated by the present disclosure, an activator can be a button, a touch screen display or any other structure that can be accessed by a human operator to initiate launching of a projectile.

The exemplary revolver 10 also includes a power system configured to rotate the barrel 12. The power system is shown schematically and referenced at 20. The power system 20 is configured to rotate the barrel 12 about the axis 26. Spinning of the barrel 12 can be transmitted to the bullet 14 through minimal friction contact between the outside of the bullet 14 and the inside of the barrel 12. The exemplary axis 26 is also the trajectory of the bullet 14 and rotation of the barrel 12 and the bullet 14 is referenced at 28. The power system 20 is configured to be rotating the barrel 12 as the firing pin mechanism 16 is projecting into the barrel 12 and engaging the primer of the projectile 14. In one or more embodiments of the present disclosure, engagement between the bullet 14 and the barrel 12 can be enhanced to promote concurrent rotation by forming complimentary grooves and fins between the external circumference of the bullet 14 and the internal circumference of the barrel 12.

The power system 20 is configured to achieve rapid rotation of the barrel 12 through any one of electromagnetic, chemical, mechanical or other source of energy. For example, an electromagnetic version of the power system 20 can apply principles of electric motors to spin the barrel 12. In another example, a chemical version of the power system 20 can harness the expansion of gases and apply the gases to fins formed on the barrel 12, such as in a turbine engine. In another example, a mechanical version of the power system 20 can apply gearing or belts or direct contact between a driving roller and the barrel 12. Certainly, more kinds of power systems become available as the size of an embodiment increases.

The exemplary revolver 10 also includes an external protective covering 22 to allow the barrel 12 to rotate without injury to a human operator. The exemplary revolver 10 also includes a cooling system to cool components of the power system 20. The cooling system is shown schematically and referenced at 24.

In one or more embodiments of the present disclosure, the barrel 12 can remain stationary and the bullet 14 can be spun within the barrel 12. In such embodiments, a portion of the bullet 14 could extend out of a rear of the barrel 12 and be acted upon by a mechanical or chemical version of the power system 20. In other embodiments in which an electromagnetic version of the power system 20 is applied, the bullet 14 could be acted upon while fully contained within the barrel 12.

In various embodiments in which the bullet 14 spins relative to the barrel 12, friction between the bullet 14 and the barrel 12 can be reduced to inhibit heat generation by creating a vacuum between the bullet 14 and the barrel 12. Such a vacuum can be maintained until the bullet 14 is fired. One or more embodiments can also be practiced wherein friction between the bullet 14 and the barrel 12 can be reduced by forming the barrel 12, the bullet 14, or both to include a friction-reducing coating. In one example, the bullet 14 can include the coating and the coating can be sacrificial, melting during firing to form a protective layer between the bullet 14 and the barrel 12 during spinning as the bullet 14 achieves its maximum rate of rotation.

Figure 2:
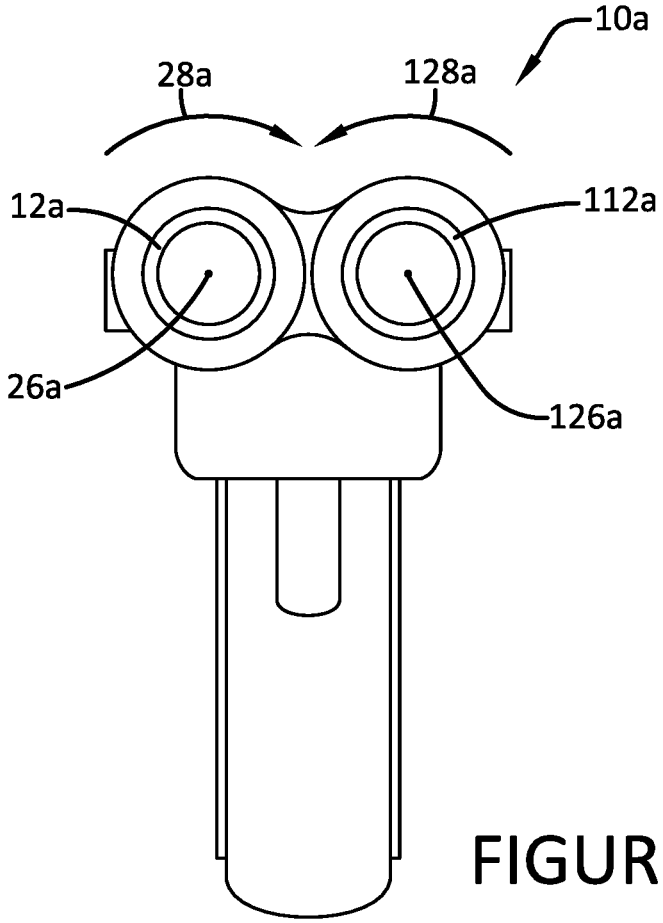
FIG. 2 is a front view of a revolver incorporating an exemplary embodiment of the present disclosure.

In one or more embodiments of the present disclosure, if the application of rotational force on the barrel 12 generates a reaction force or moment, an arrangement of springs can be positioned between the barrel 12 and the cover 22 to inhibit the reaction force from disturbing the aim and alignment of the barrel 12 as desired by the user. In one or more other embodiments of the present disclosure, the revolver 10 can include two barrels. For example, FIG. 2 shows a front view of a revolver 10*a* with a barrels 12*a* and 112*a*. The exemplary barrels 12*a*, 112*a* are aligned as an adjacent pair, like the barrels of a double-barreled shotgun. The respective directions of spin of the barrels 12*a*, 112*a* are opposite so that there is no net tendency for the revolver 10*a* to spin or lurch. The exemplary barrel 12*a* spins in a first rotational direction 28*a* about an axis 26*a*. The exemplary barrel 112*a* spins in a second rotational direction 128*a* about an axis 126*a*. The first rotational direction 28*a* is opposite to the second rotational direction 128*a*.

Figure 3:
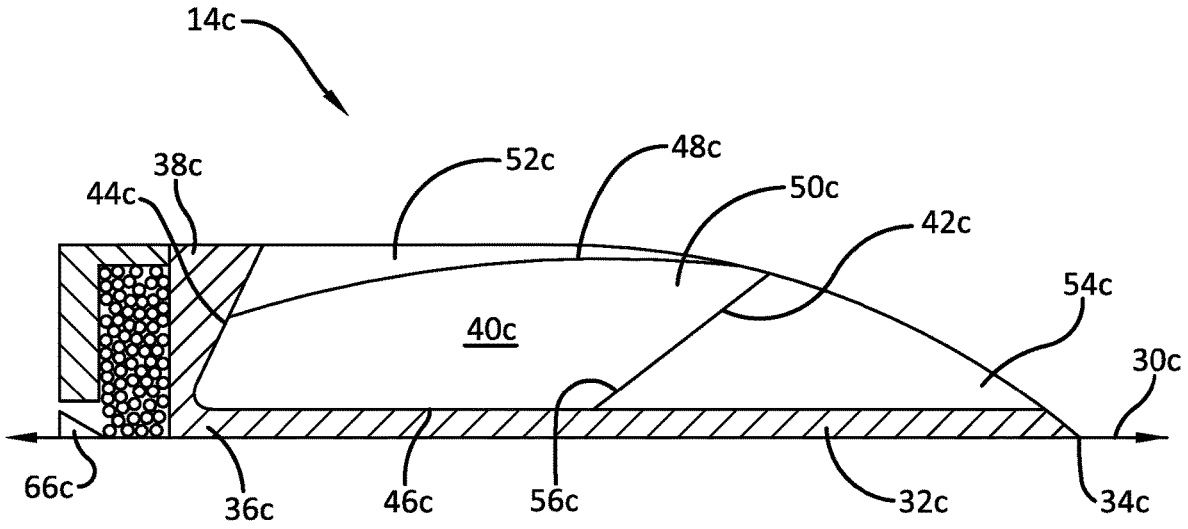
FIG. 3 is a cross-sectional view of one-half of a bullet according to the present disclosure, wherein a central longitudinal axis of the bullet in the plane of view.

In another aspect of the present disclosure, an improved projectile is provided. FIG. 3 is a cross-sectional view of one-half of a bullet or projectile 14*c* according to an exemplary embodiment of the present disclosure. The projectile 14*c* is an exemplary projectile and extends along a central, projectile longitudinal axis 30*c*. The central longitudinal axis 30*c* of the projectile 14*c* is in the plane of view of FIG. 3. It is noted that FIG. 3 shows a "top half" of the projectile 14*c* and a "bottom half" would be a mirror image of the top half.

The exemplary projectile 14*c* includes several components which are held together during flight despite the centrifugal force created by rapid spinning. The exemplary projectile 14*c* includes primer 66*c*, a quantity of propellant 68*c*, and at least one sub-projectile 40*c*. The exemplary projectile 14*c* includes a central, roughly cylindrical rod 32*c* serving as a core of the projectile 14*c*. The rod 32*c* extends from a forward end or leading tip 34*c* of the projectile 14*c* to an aft end or base 36*c* of the projectile 14*c*. Electromagnetic forces applied to rotate the projectile 14*c* can be acting on the rod 32*c*. Radiating flanges, such as flange 38*c*, extend radially outwardly from the base 36*c* and at an intermediate region between the tip 34*c* and the base 36*c*. The exemplary flange 38*c* projects away from the rod 32*c* transverse to the projectile longitudinal axis 30*c* at the aft end 36*c*. The sub-projectile 40*c* abuts the flange 38*c* and the rod 32*c*. It is noted that the flanges 38*c* can be formed to extend radially beyond a remainder of the projectile 14*c*. Such flanges 38*c* could act as fins of appropriate size and shape, to enhance rotation of the projectile 14*c* and minimize the air resistance acting on the projectile 14*c* so that the projectile 14*c* can maintain a maximum forward velocity and travel longer distances. It is noted that, in one or more projectiles according to the present disclosure, subcomponents within a projectile can be interconnected with circumferential springs or wire so that the subcomponents separate in response to a predetermined level of centrifugal force.

Figure 4:
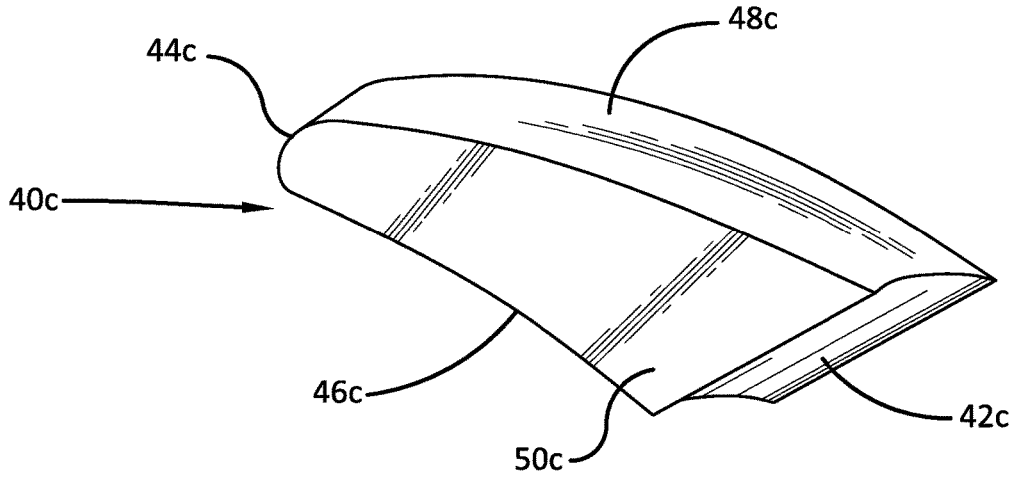
FIG. 4 is an isometric view of an exemplary sub-projectile according to the present disclosure.

The exemplary projectile 14*c* includes a peripheral outer shell formed from a plurality of shrapnel pieces or sub-projectiles. An exemplary sub-projectile is referenced at 40*c*. FIG. 4 is an isometric view of the exemplary sub-projectile 40*c*. The exemplary sub-projectile 40*c* includes a forward face 42*c*, an aft face 44*c*, a radially inner face 46*c*, and a radially outer face 48*c*. A lateral side of the sub-projectile 40*c* is referenced at 50*c*.

The sub-projectiles can be interlocked with one another and/or with the flanges 38*c* so that the sub-projectiles spin together. The sub-projectiles can be shaped as desired and held together by interdigitations and/or other connections to the flanges 38*c* at the base 36*c*. FIG. 3 shows that a layer 52*c* of material can cover the sub-projectile 40*c*. The layer 52*c* can be anti-friction material or a warfare agent such as an incendiary (flammable), chemical warfare or radioactive material.

The projectile 14*c* can be constructed so that the tip 34*c* of the rod 32*c* is the first point of the projectile 14*c* to strike the target. The stopping/slowing force acting on the tip 34*c* at impact with the target can cause the interdigitated outer sub-projectiles, such as piece 40*c*, to no longer be constrained to move together. Each piece can be directed forward by momentum and outwards from the trajectory, in a direction between the trajectory of the projectile 14*c* and a plane perpendicular to it. Thus, energy associated with the spin of the projectile 14*c* as well as energy associated with rectilinear forward motion of the projectile 14*c* can be utilized to damage the target.

In the exemplary embodiment, the disassembly of the outer shell of the projectile 14*c* can be achieved by the forward momentum of the sub-projectiles. In the exemplary embodiment, the projectile 14*c* includes forward portions, such as a forward portion referenced at 54*c*. The forward portion 54*c* can be integrally-formed with the rod 32*c* or separately-formed and fixed to the rod 32*c*. The rod 32*c* and the forward portion 54*c* can remain connected when the projectile 14*c* initially strikes the target. The forward portion 54*c* defines a rearwardly-facing ramp face 56*c*. The forward face 42*c* extends flush on the ramp face 56*c*. The exemplary sub-projectile 40*c* and the exemplary forward portion 54*c* are not fixed together. When the projectile 14*c* strikes the target, the forward face 42*c* of the sub-projectile 40*c* rides up the ramp face 56*c*, causing uncoupling of the sub-projectile 40*c* from the projectile 14*c* and movement of the sub-projectile 40*c* at the angle of the ramp face 40*c* relative to the axis 30*c*.

Separation of the sub-projectiles can be accomplished in other ways in other embodiments of the present disclosure. For example, explosive charges can be positioned inside the rod 32*c* and be arranged to detonate when the tip 34*c* strikes the target. In other embodiments, the base 36*c* can be configures to fragment when the tip 34*c* strikes the target. Dispersion of the portions of the projectile 14*c* can also be enhanced by varying the density of the sub-projectiles. As the rate of rotation decreases when the tip 34*c* strikes the target, denser sub-projectiles can move relative to less dense sub-projectiles because of the differences in angular momentum, causing unlocking of tessellations that interconnect the sub-projectiles.

In another aspect of the present disclosure, the rod 32*c* can be hollow and contain a molten fluid that is released gradually during the flight of the projectile 14*c* because of the centrifugal spin of the projectile 14*c*. The fluid can serve any desired purpose. For example, the fluid can minimize air resistance. Alternatively, the projectile 14*c* can be configured so that the fluid is released only when spin velocity decreases below some predetermined threshold. In such an embodiment, the fluid can be a warfare agent such as an incendiary, chemical or radioactive material.

In another aspect of the present disclosure, in one or more embodiments of the present disclosure, a cross sectional shape of the barrel can change as the rotational speed of the barrel is increased to a maximum spin velocity. This can be accomplished by forming circumferential portions of the barrel with different materials having different densities. In such embodiments, the cross-sectional shape of the barrel can change to a circular cross section from an ovoid cross section. This change would allow the bullet to fire and pass through the barrel when sufficient pressure behind the bullet and sufficient spin velocity of the barrel has been achieved. A bullet used with such a barrel can also be configured to change its cross-sectional shape while attaining maximum spin velocity by virtue of different density of material along its circumference. A cross-sectional shape of such a bullet could change into a circular cross section from an ovoid cross section, allowing the bullet to fire and pass through the barrel when sufficient pressure behind the bullet and sufficient spin velocity is achieved. Such a bullet could also change shape during travel, returning to an ovoid cross section during flight as spin velocity decreases to release its shell shrapnel components (sub-projectiles) in a centrifugal direction when the velocity is decreased by air friction or impact with its target.

Figure 5:
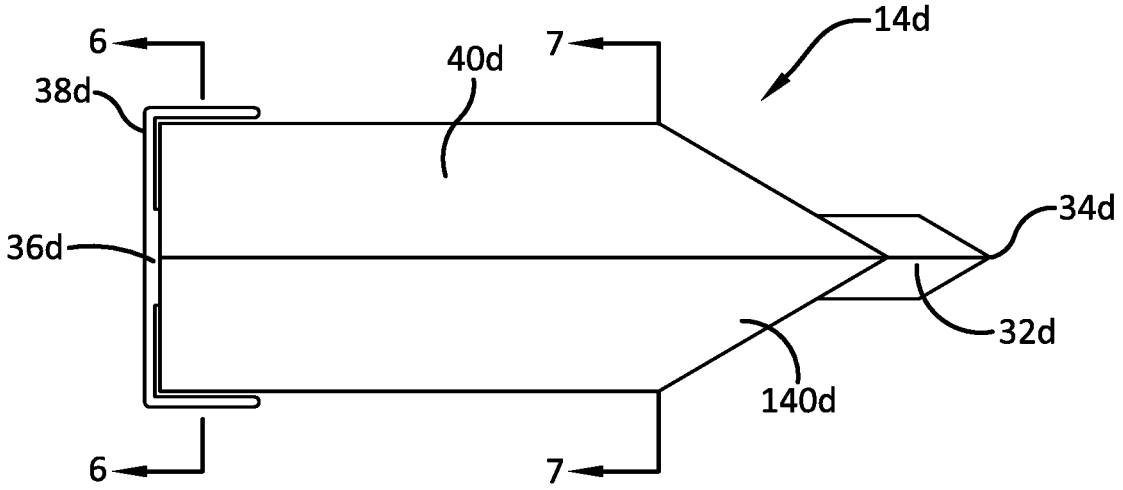
FIG. 5 is a side view of a bullet according to the present disclosure.
Figure 6:
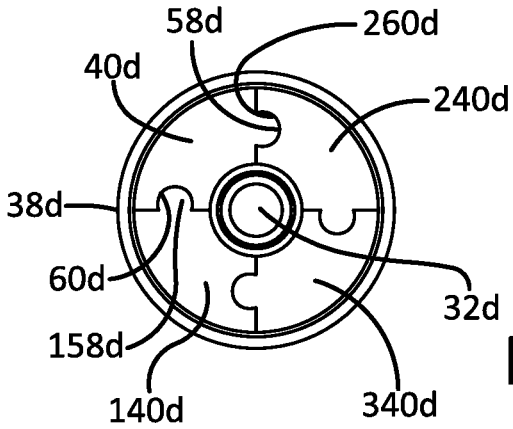
FIG. 6 is a cross-sectional view through section lines 6-6 in FIG. 5.
Figure 7:
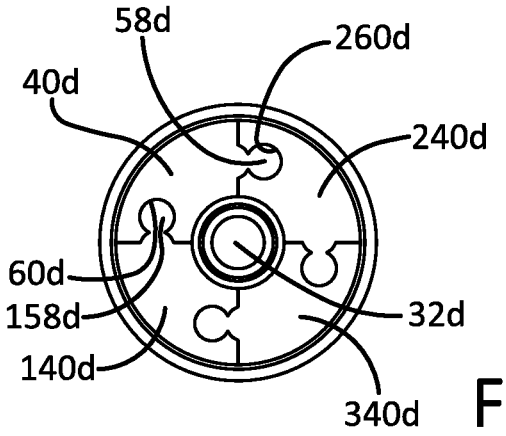
FIG. 7 is a cross-sectional view through section lines 7-7 in FIG. 5.

FIG. 5 is a side view of a bullet 14*d* according to another exemplary embodiment of the present disclosure. The exemplary bullet 14*d* includes several components which are held together during flight despite the centrifugal force created by rapid spinning. The exemplary bullet 14*d* includes a central, roughly cylindrical rod 32*d* serving as a core of the bullet 14*d*. The rod 32*d* extends from a leading tip 34*d* of the bullet 14*d* to a base 36*d* of the bullet 14*d*. A circumferential, cup-like flange 38*d* extends radially outwardly from the base 36*d*.

The exemplary bullet 14*d* includes a peripheral outer shell formed from a plurality of sub-projectiles 40*d*, 140*d*, 240*d*, 340*d*. The exemplary sub-projectiles 40*d*, 140*d*, 240*d*, 340*d* are interlocked with one another with tongue and groove structures. For example, the sub-projectile 40*d* includes a tongue 58*d* that is received in groove 260*d* of the sub-projectile 240*d*. The sub-projectile 40*d* also includes a groove 60*d* that receives a tongue 158*d* of the sub-projectile 140*d*.

In the exemplary bullet 14*d*, the cross-section of the interlocking pattern of tongues and grooves changes gradually between the base 36*d* and the tip 34*d*. At the loss of the retaining cup-like flange 38*d* that is initiated by the tip 34*c* striking a target, centrifugal forces cause separation of the sub-projectiles. The separation starts at the base 36*d* and continues toward the tip 34*c*.

Figure 8:
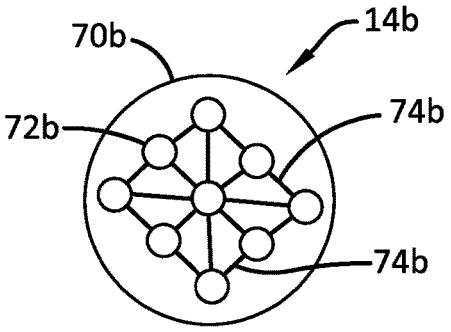
FIG. 8 is a cross-sectional view through a projectile and taken in a plane normal to a longitudinal axis of the projectile.
Figure 9:
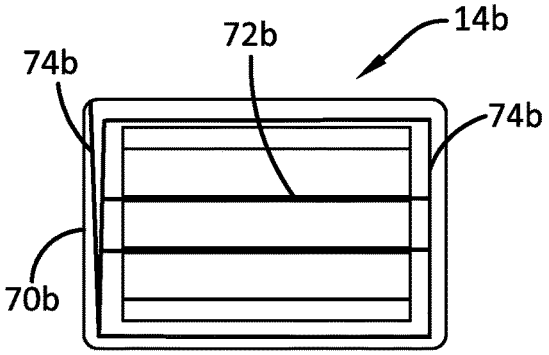
FIG. 9 is a side view of the projectile shown in FIG. 8.
Figure 10:
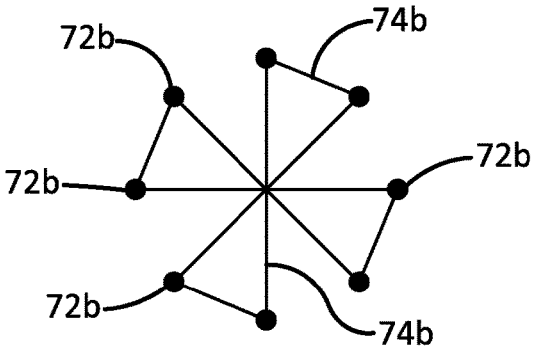
FIG. 10 is an expansion pattern achieved by a projectile.
Figure 11:
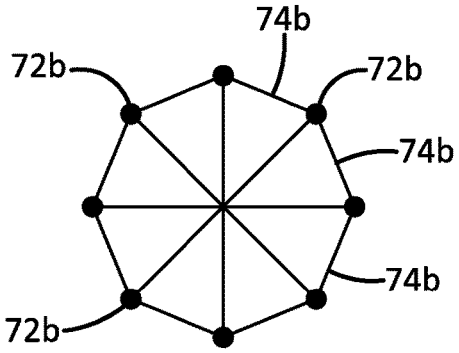
FIG. 11 is an expansion pattern achieved by an alternative projectile.
Figure 12:
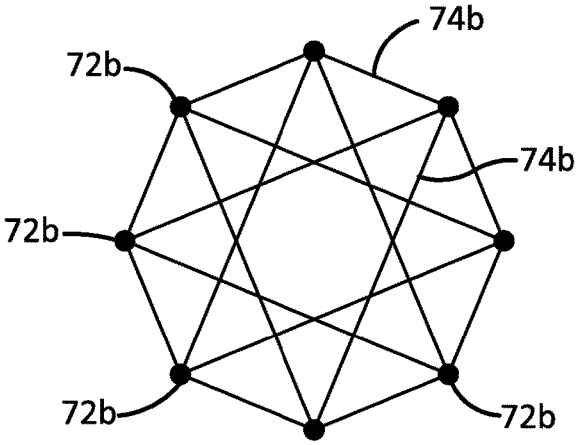
FIG. 12 is an expansion pattern achieved by an alternative projectile.
Figure 13:
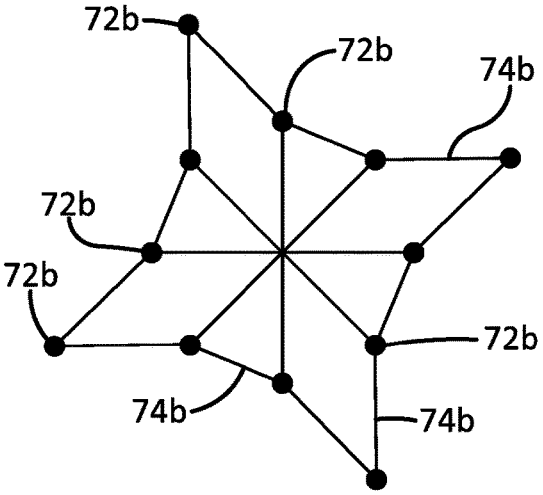
FIG. 13 is an expansion pattern achieved by an alternative projectile.

FIGS. 8-9 relate to a projectile 14*b* containing rotating interconnected shrapnel (sub-projectiles) which can expand to form a spinning net when cohesion of the shrapnel pieces is overcome by centrifugal force. An outer jacket of the projectile 14*b* is referenced at 70*b*. The projectile 14*b* includes sub-projectiles in the form of a plurality of rods 72*b*. The projectile 14*b* also includes wires interconnecting the rods 72*b*, referenced at 74*b*. It is noted that the primer and propellant is not shown, but are components of the projectile 14*b*.

Upon launching of the projectile 14*b*, cohesion of the rods 72*b* is overcome by centrifugal force and the projectile 14*b* morphs into a spinning net. FIGS. 10-13 show various patterns of spinning nets that can be formed after expansion of the rods 72*b* while still held together by interconnecting wires 74*b*. The projectile 14*b* may be useful in increasingly effective diameter of the projectile at a distance and compensate for decreases in accuracy over distance. This embodiment may also be useful for combating airborne targets such as missiles or grounds and in some embodiments may be modified to be sublethal incapacitating devices.

While the present disclosure has been described with reference to an exemplary embodiment, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the appended claims. The right to claim elements and/or sub-combinations that are disclosed herein is hereby unconditionally reserved. The use of the word "can" in this document is not an assertion that the subject preceding the word is unimportant or unnecessary or "not critical" relative to anything else in this document. The word "can" is used herein in a positive and affirming sense and no other motive should be presumed. More than one "invention" may be disclosed in the present disclosure; an "invention" is defined by the content of a patent claim and not by the content of a patent application specification.

What is claimed is:

1. A projectile launching system comprising:

a projectile including a primer, a quantity of propellant, and at least one sub-projectile;

a projectile launcher including:

at least one barrel extending along a longitudinal axis between a first end and a second end, wherein said second end defines an exit port of said barrel;

said projectile positioned in said at least one barrel closer to said first end;

a firing pin mechanism positioned at said first end and configured to, at least partially, selectively project into said at least one barrel and engage said primer of said projectile whereby said quantity of propellant is ignited and said projectile is launched through and out of said at least one barrel;

an activator engaged with said firing pin mechanism and engageable by a user of said projectile launcher to control said firing pin mechanism to project into said at least one barrel and engage said primer of said projectile; and a power system engaged with at least one of said at least one barrel and said projectile and configured to rotate said at least one of said at least one barrel and said projectile about said longitudinal axis as said firing pin mechanism is projecting into said at least one barrel and engaging said primer of said projectile and before said projectile is fired from said at least one barrel and before force is imparted to said projectile that directs said projectile through said at least one barrel.

2. The projectile launching system of claim 1 wherein the at least one barrel is further defined as a plurality of barrels.

3. The projectile launching system of claim 1 wherein said projectile further comprises:

a layer of material covering an outer surface of said sub-projectile, said layer an anti-friction material, a flammable material, a radioactive material, or a chemical warfare material.

4. A projectile launching system comprising:

a projectile including a primer, a quantity of propellant, and at least one sub-projectile;

a projectile launcher including:

at least one barrel extending along a longitudinal axis between a first end and a second end, wherein said second end defines an exit port of said barrel;

said projectile positioned in said at least one barrel closer to said first end;

a firing pin mechanism positioned at said first end and configured to, at least partially, selectively project into said at least one barrel and engage said primer of said projectile whereby said quantity of propellant is ignited and said projectile is launched through and out of said at least one barrel;

an activator engaged with said firing pin mechanism and engageable by a user of said projectile launcher to control said firing pin mechanism to project into said at least one barrel and engage said primer of said projectile;

a power system engaged with at least one of said at least one barrel and said projectile and configured to rotate said at least one of said at least one barrel and said projectile about said longitudinal axis as said firing pin mechanism is projecting into said at least one barrel and engaging said primer of said projectile; and wherein said projectile extends along a projectile longitudinal axis between and aft end and forward end spaced from one another along said projectile longitudinal axis and further comprises:

a rod centrally disposed and extending along said projectile longitudinal axis between said aft end and said forward end; and at least one flange projecting away from said rod transverse to said projectile longitudinal axis at said aft end, wherein said at least one sub-projectile abuts said at least one flange and said rod.

5. The projectile launching system of claim 4 wherein said projectile further comprises:

a forward portion that is one of integrally-formed with said rod and separately-formed and fixed to the rod, wherein said forward portion defines a ramp face.

6. The projectile launching system of claim 5 wherein said at least one sub-projectile further comprises a forward face extending flush on said ramp face.

7. The projectile launching system of claim 6 wherein said at least one sub-projectile and said forward portion are not fixed together.

8. A projectile launching system comprising:

a projectile including a primer, a quantity of propellant, and at least one sub-projectile;

a projectile launcher including:

at least one barrel extending along a longitudinal axis between a first end and a second end, wherein said second end defines an exit port of said barrel;

said projectile positioned in said at least one barrel closer to said first end;

a firing pin mechanism positioned at said first end and configured to, at least partially, selectively project into said at least one barrel and engage said primer of said projectile whereby said quantity of propellant is ignited and said projectile is launched through and out of said at least one barrel;

an activator engaged with said firing pin mechanism and engageable by a user of said projectile launcher to control said firing pin mechanism to project into said at least one barrel and engage said primer of said projectile;

a power system engaged with at least one of said at least one barrel and said projectile and configured to rotate said at least one of said at least one barrel and said projectile about said longitudinal axis as said firing pin mechanism is projecting into said at least one barrel and engaging said primer of said projectile; and wherein said at least one sub-projectile further comprises at least a first sub-projectile and a second sub-projectile and one of said first sub-projectile and said second sub-projectile includes a tongue and the other of said first sub-projectile and said second sub-projectile includes a groove, said tongue is received in said groove.

9. A projectile launching system comprising:

a projectile including a primer, a quantity of propellant, and at least one sub-projectile;

a projectile launcher including:

at least one barrel extending along a longitudinal axis between a first end and a second end, wherein said second end defines an exit port of said barrel;

said projectile positioned in said at least one barrel closer to said first end;

a firing pin mechanism positioned at said first end and configured to, at least partially, selectively project into said at least one barrel and engage said primer of said projectile whereby said quantity of propellant is ignited and said projectile is launched through and out of said at least one barrel;

an activator engaged with said firing pin mechanism and engageable by a user of said projectile launcher to control said firing pin mechanism to project into said at least one barrel and engage said primer of said projectile;

a power system engaged with at least one of said at least one barrel and said projectile and configured to rotate said at least one of said at least one barrel and said projectile about said longitudinal axis as said firing pin mechanism is projecting into said at least one barrel and engaging said primer of said projectile;

wherein said at least one sub-projectile further comprises at least a first sub-projectile and a second sub-projectile and one of said first sub-projectile; and said projectile further comprises at least one wire interconnecting said first sub-projectile and said second sub-projectile.

10. A projectile launching system comprising:

a projectile;

a projectile launcher including:

at least one barrel extending along a longitudinal axis between a first end and a second end, wherein said second end defines an exit port of said barrel, said projectile positioned in said at least one barrel closer to said first end;

a firing pin mechanism positioned at said first end and configured to, at least partially, selectively project into said at least one barrel and engage said projectile whereby said projectile is launched through and out of said at least one barrel;

an activator engaged with said firing pin mechanism and engageable by a user of said projectile launcher to control said firing pin mechanism to project into said at least one barrel and engage said projectile; and a power system engaged with at least one of said at least one barrel and said projectile and configured to rotate said at least one of said at least one barrel and said projectile about said longitudinal axis as said firing pin mechanism is projecting into said at least one barrel and engaging said projectile and before said projectile is fired from said at least one barrel and before force is imparted to said projectile that directs said projectile through said at least one barrel.

* * * * *